US006374645B1

(12) United States Patent
Fontes et al.

(10) Patent No.: US 6,374,645 B1
(45) Date of Patent: Apr. 23, 2002

(54) SECURITY LOCKS

(75) Inventors: Ross M. Fontes, Irvine; Andrew J. March, Lake Forest; David R. Millar, Orange, all of CA (US)

(73) Assignee: Spoonfish, Inc., Newport Beach, CA (US)

( * ) Notice: Subject to any disclaimer, the term of this patent is extended or adjusted under 35 U.S.C. 154(b) by 0 days.

(21) Appl. No.: 09/574,717

(22) Filed: May 18, 2000

Related U.S. Application Data

(62) Division of application No. 09/268,903, filed on Mar. 15, 1999, now Pat. No. 6,230,526.

(51) Int. Cl.[7] ..... E05B 73/00

(52) U.S. Cl. ..... 70/18; 70/30; 70/58; 280/809; 280/814

(58) Field of Search ..... 70/18, 58, 30, 70/49; 280/809, 814, 87.042, 637

(56) References Cited

U.S. PATENT DOCUMENTS

| | | | | | |
|---|---|---|---|---|---|
| 3,023,022 | A | | 2/1962 | Boyden | 280/87.04 |
| 3,101,695 | A | | 8/1963 | Honeyman | 114/230 |
| 3,481,617 | A | | 12/1969 | Salomon | 280/11.35 |
| 3,625,031 | A | * | 12/1971 | Alley, III | 70/58 |
| 3,670,535 | A | * | 6/1972 | Stettner et al. | 70/58 |
| 3,714,803 | A | * | 2/1973 | Chenenko | 70/58 |
| 3,727,934 | A | * | 4/1973 | Averbook et al. | 70/58 X |
| 3,941,397 | A | * | 3/1976 | Kidder et al. | 70/312 X |
| 3,990,713 | A | | 11/1976 | Hokanson | 280/87.04 |
| 3,999,410 | A | | 12/1976 | Hall | 70/58 |
| 4,082,306 | A | | 4/1978 | Sheldon | 280/87.04 |
| 4,231,586 | A | | 11/1980 | Krause | 280/637 |
| 4,340,376 | A | | 7/1982 | Williams | 441/74 |
| 4,458,907 | A | | 7/1984 | Meredith | 280/87.04 |
| 4,685,697 | A | * | 8/1987 | Thorley | 280/637 |
| 4,702,495 | A | | 10/1987 | Roda | 280/814 |
| 4,733,840 | A | * | 3/1988 | D'Amore | 70/18 X |
| 4,773,239 | A | * | 9/1988 | Lowe et al. | 70/38 A |
| 4,922,735 | A | | 5/1990 | Leary | 70/58 |
| 4,962,968 | A | | 10/1990 | Caplin | 301/108 |
| 4,970,883 | A | | 11/1990 | Johnson | 70/30 |
| 5,005,868 | A | * | 4/1991 | Stern et al. | 280/814 |
| 5,026,088 | A | * | 6/1991 | Stuart | 280/814 X |

(List continued on next page.)

FOREIGN PATENT DOCUMENTS

| | | | | |
|---|---|---|---|---|
| CA | 961296 | | 1/1975 | 70/12 |
| CH | 171069 | * | 8/1934 | 280/637 |
| CH | 227612 | * | 9/1943 | 280/809 |
| DE | 2400979 | * | 7/1975 | 70/58 |
| DE | 2734212 | | 2/1979 | 280/814 |
| DE | 3133240 | * | 3/1983 | 280/637 |
| DE | 4238857 | * | 5/1994 | 280/814 |
| FR | 1499959 | | 9/1967 | |
| FR | 2517215 | | 6/1983 | 280/814 |
| FR | 2569991 | * | 3/1986 | 280/809 |
| FR | 2677261 | * | 12/1992 | 280/637 |

*Primary Examiner*—Lloyd A. Gall
(74) *Attorney, Agent, or Firm*—Lyon & Lyon LLP

(57) ABSTRACT

There is disclosed herein a relatively simple locking device for sporting items such as skateboards, snowboards, snow skis, and the like. In one form of the locking device, the same includes a member which can be affixed to a wheel truck of a skateboard, binding of a snowboard, or binding of a snow ski, and includes a releasable cable which can be wrapped around a fixed or stationary object so as to secure the sporting item. In one embodiment, the cable can be extended and retracted from the body of the locking device so as to provide a suitable length of the cable for the securing function. In another embodiment, the cable is normally retained in a flanged section of the locking device, but can be released therefrom for attachment to the fixed or stationary object. Another embodiment includes a removable cable and lock, and a further embodiment provides a relatively simple locking bracket, particularly for use between the wheel truck and board of a skateboard and which can be used with a separate cable and lock.

12 Claims, 12 Drawing Sheets

U.S. PATENT DOCUMENTS

| | | | | | |
|---|---|---|---|---|---|
| 5,100,161 | A | | 3/1992 | Tillyer | 280/87.042 |
| 5,119,649 | A | | 6/1992 | Spence | 70/14 |
| 5,177,986 | A | | 1/1993 | Jensen | 70/18 |
| 5,179,847 | A | | 1/1993 | Dorn | 70/18 |
| 5,306,046 | A | * | 4/1994 | Stanley | 70/58 X |
| 5,522,620 | A | | 6/1996 | Pracas | 280/87.041 |
| 5,531,082 | A | | 7/1996 | Wolk et al. | 70/63 |
| 5,706,680 | A | | 1/1998 | Wroble | 70/18 |
| 5,711,539 | A | | 1/1998 | Tang | 280/11.27 |
| 5,749,251 | A | * | 5/1998 | Keefe | 70/58 X |
| 5,769,438 | A | | 6/1998 | Svetlov | 280/87.041 |
| 5,901,588 | A | | 5/1999 | Frost | 70/39 |
| 5,904,056 | A | | 5/1999 | Ozaki | 70/18 |
| 6,059,315 | A | | 5/2000 | Selph | 280/809 |
| 6,089,054 | A | * | 7/2000 | Stukas et al. | 70/58 X |
| 6,230,526 | B1 | * | 5/2001 | Fontes et al. | 70/18 |

* cited by examiner

SECURITY LOCKS

This application is a divisional application of application Ser. No. 09/268,903, filed on Mar. 15, 1999, now U.S. Pat. No. 6,230,526.

This invention relates to security devices, and more particularly to security locks for use on devices such as skateboards, snowboards, snow skis, and the like.

BACKGROUND OF THE INVENTION

Skateboarding, snowboarding and snow skiing are all extremely popular sports today. It has been reported that skateboarding ranks in sixth place in popularity in all sports and is one of the fastest growing sports today. One out of every ten teenagers owns or rides a skateboard. Skateboarding is increasing globally both as a competitive sport, and as a mode of transportation for today's youth. There are primarily two types or styles of skateboards, namely a short one used for high performance such as tricks, competition, and exhibitions, and longboards used for downhill competitions as well as transportation to school, the beach, and neighborhood activities. Today, skateboards often replace bicycles as the preferred mode of transportation.

Like skateboarding, snowboarding is one of the fastest growing sports today. One out of every four persons who regularly visits ski resorts owns or rides a snowboard. Snowboarding is increasing globally both as a competitive sport as well as an alternative to conventional skiing. Snow skiing is still the most popular winter time sport in the world today.

These types of equipment are relatively expensive. For example, skateboards are an expensive investment, particularly for young people, ranging from around $100 to $300 each. Currently, skateboarders have to carry their boards while walking through a mall, at school or bury it in the sand at the beach so as to prevent theft.

As to snowboarding and snow skiing, whether a person uses one or the other, the need for protecting the equipment in today's increasingly crowded ski resorts is a must. As more and more people turn to snowboarding and skiing, the risk of theft is a growing concern.

Some people make use of steel cables with locks which can be used to secure any of these types of equipment to some fixed object such as a secure pole. Unfortunately, these types of cable-lock devices must be carried by the person using the sporting equipment; for example, a skateboarder traveling to the beach to surf has to physically carry the locking device, which tends to be bulky.

Ski resorts frequently have racks for skis, but which normally are not provided with any type of locking system, and such resorts generally have not yet addressed some type of rack for snowboards. As more and more people turn to these sports, the risk of theft is a growing concern.

Therefore, there is a need for a reliable locking device. Some forms of locking devices have been devised as is evidenced by U.S. Pat. Nos. 4,773,239, 5,179,847, 5,177,986, 5,706,680. However, these devices either involve locking devices that must be carried on the person while the sporting equipment is in use, such as a separable lock device, or they involve relatively bulky or complicated devices.

A suitable locking device would allow the skateboard rider protection against theft. The present locking devices offer the skateboarder the opportunity for protection currently only available to bicyclists and motorists.

Accordingly, it is a principal object of the present invention to provide a relatively simple locking device or system for sports equipment like skateboards, snowboards, snow skis, and the like.

A further object of the present invention is to provide a locking device for sports equipment, such as skateboards, snowboards, snow skis, and the like which does not require the person to carry a lock, cable or other separate locking device.

A further object of the present invention is to provide an improved security device for sports equipment.

The locking devices of the present invention will help deter a would-be thief from stealing skateboards, snowboards, snow skis, and the like while the rider eats lunch, goes to the lodge, car, beach or any other situation would involve leaving their equipment behind for any length of time. The present locking concepts can provide the skateboarder, snowboarder and skier extra peace of mind by knowing their equipment is secure.

BRIEF DESCRIPTION OF THE DRAWINGS

These and other objects and features of the present invention will become better understood through a consideration of the following description taken in conjunction with the drawings in which.

Figure 6:
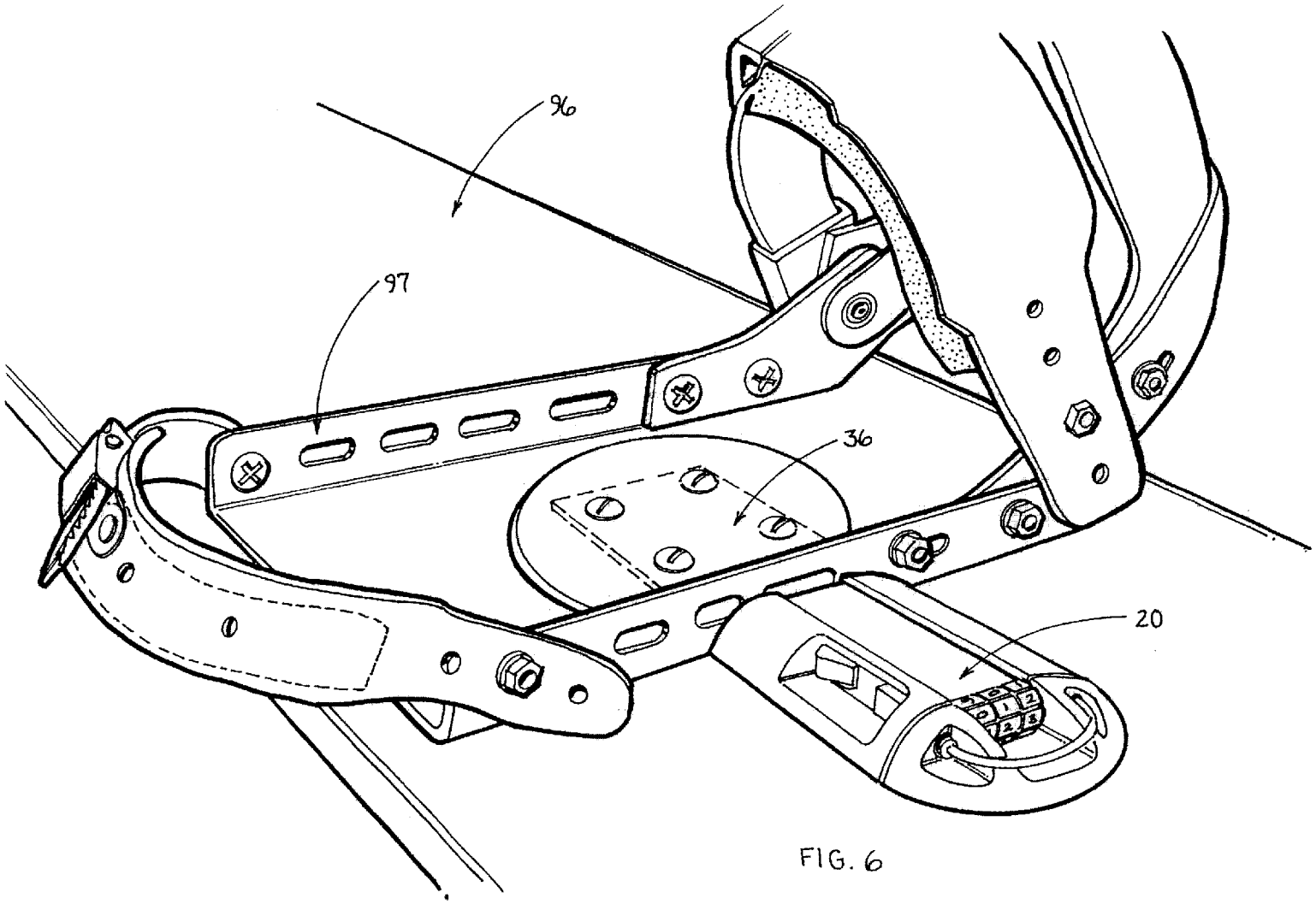
Figure 7:
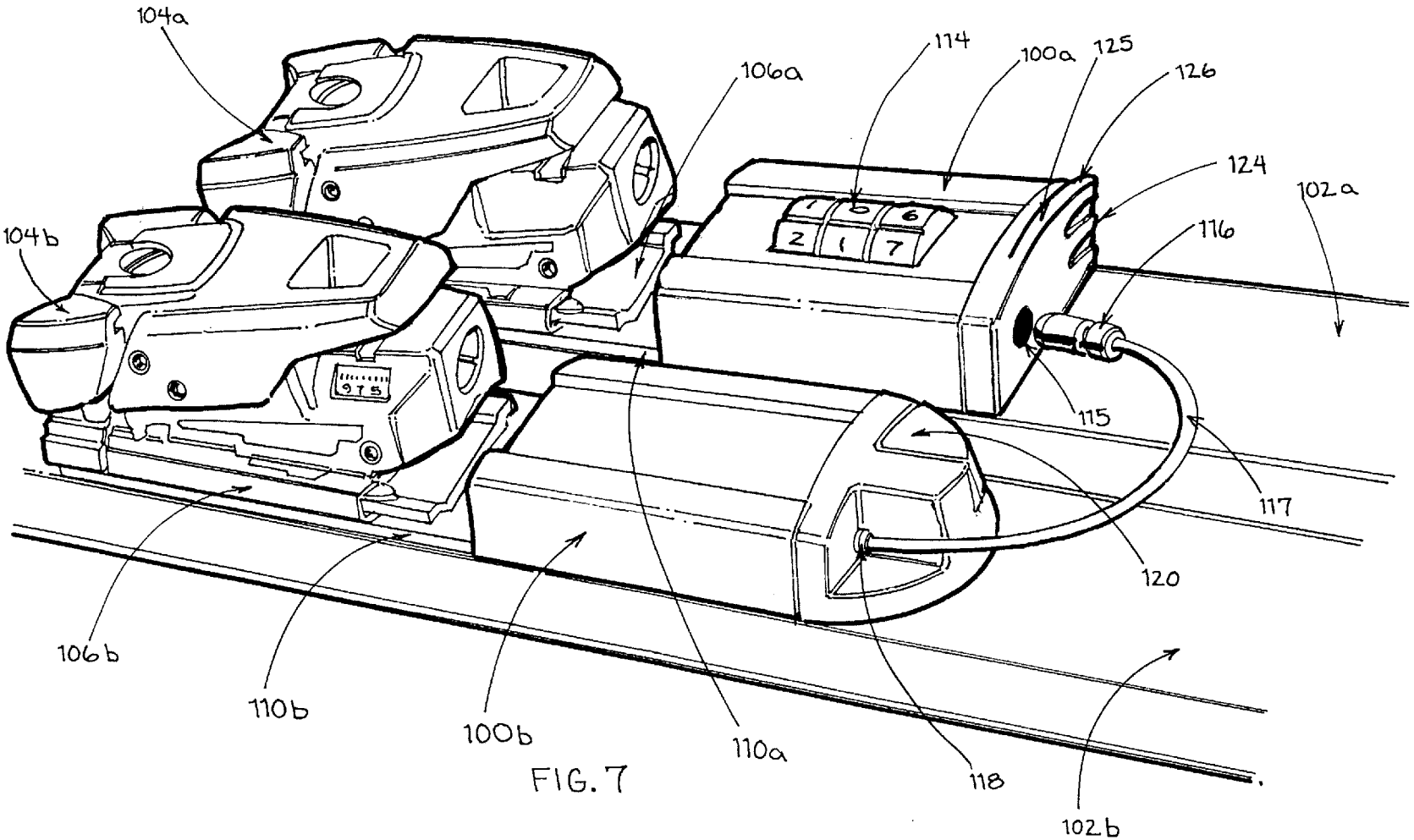

5B is a perspective detailed view of a portion thereof;

FIG. 6 is a perspective view of an embodiment of a locking device according to the present invention for use with a snowboard;

FIG. 7 is a perspective view partially showing a pair of snow skis and a further embodiment of a locking device of the present invention for use with snow skis.

Figure 8:
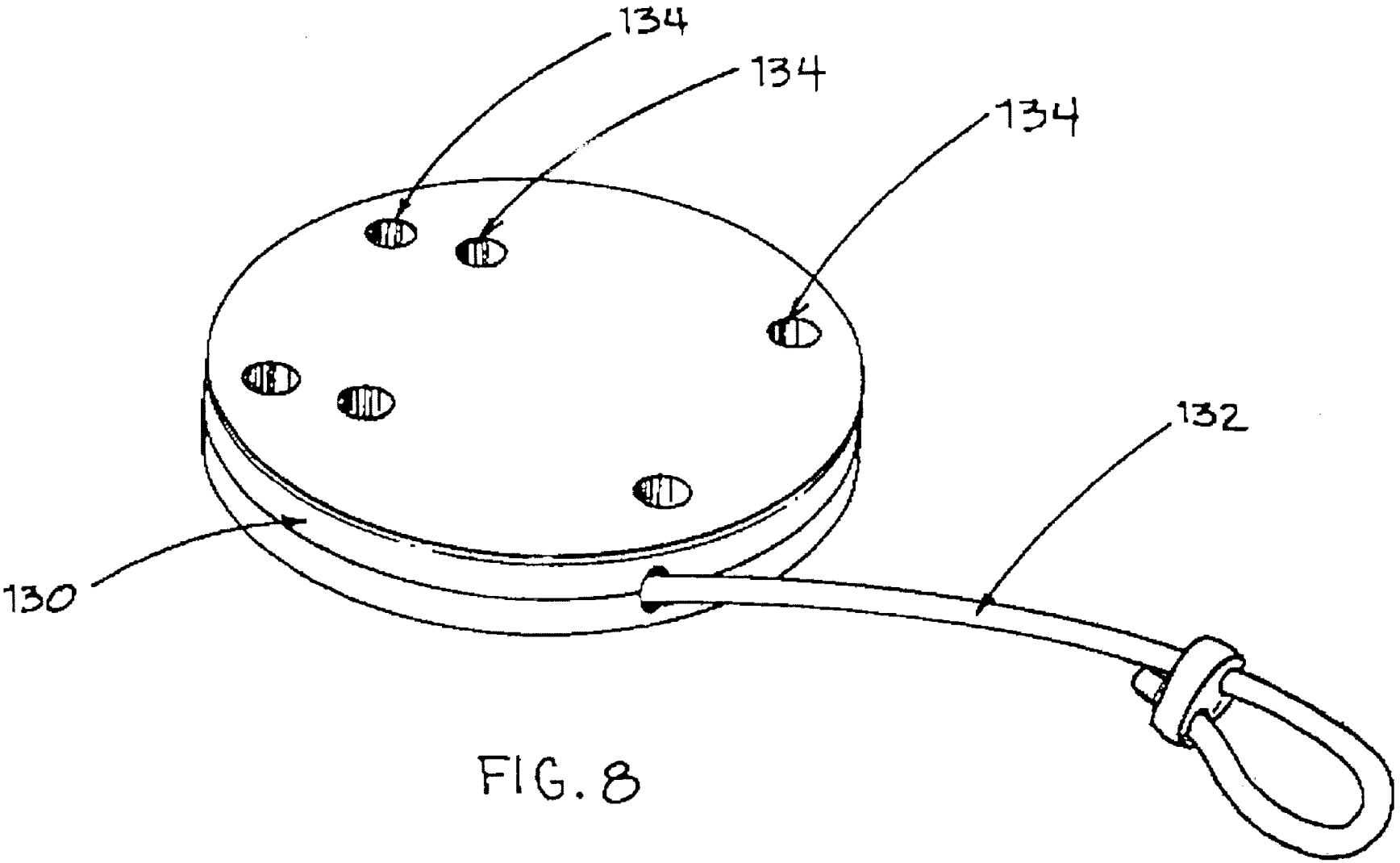

FIG. 8 is a perspective view of another alternative locking device for skateboards and the like.

Figure 9:
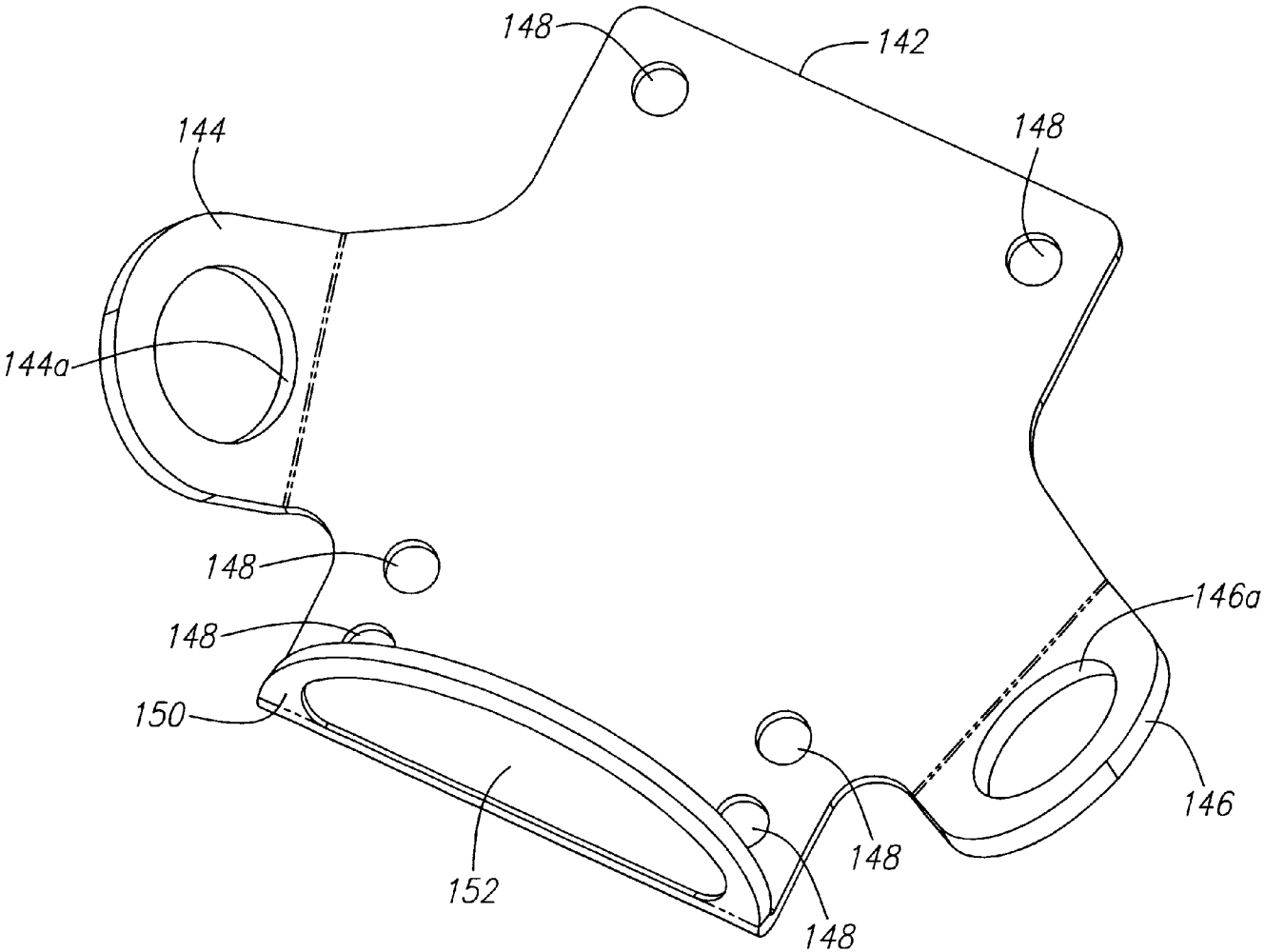

FIG. 9 is a perspective view of an alternative form of bracket which can be used with skateboards and other devices along with some form of locking cable or chain.

SUMMARY OF THE INVENTION

According to the present invention, a relatively simple and compact locking device is provided for skateboards, snowboards, snow skis, and the like. In one embodiment, the device comprises a compact and self-contained cable lock which can be mounted to the truck of a skateboard, boot bracket attachment of a snowboard, or binding of a snow ski so as to be securely affixed to the sports item. A lock can include a releasable cable which normally is retracted into the locking device, but which can be extended to lock around a fixed pole or other fixed or stationary object so as to secure the sporting item thereto. Other embodiments have different forms of cable lock assemblies. In another embodiment, a relatively simple bracket is provided which can be securely attached, for example, between the wheel truck and skateboard body, and be used with a cable and lock for securing the sporting item when desired.

DETAILED DESCRIPTION

Figure 1:
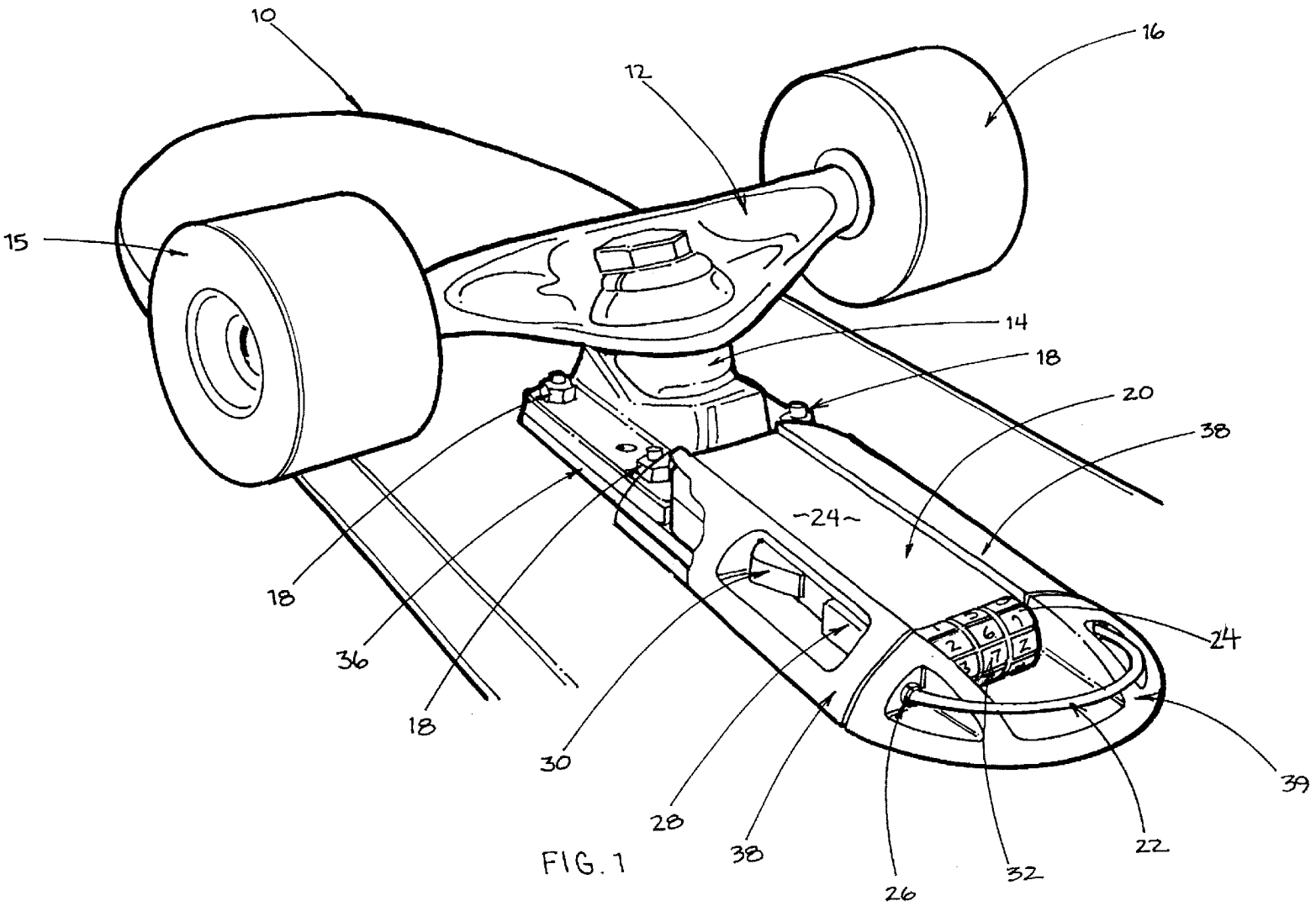
FIG. 1 is a partial perspective view of a skateboard and a first embodiment of a locking device according to the present invention for sporting equipment.

Turning now to the drawings, and first to FIG. 1, a portion of one end of the bottom of a skateboard 10 is shown and which has a conventional wheel truck 12 with a truck base 14 and wheels 15 and 16, it being understood that the skateboard has a similar wheel assembly at the other end thereof (not shown in FIG. 1, but see FIG. 5A) as is conventional. The wheel truck base 14 has several holes through which the same is attached to the underside of the skateboard 10 by bolts and nuts 18 in a conventional manner.

According to a first embodiment of the present invention, a combination lock assembly 20 is affixed to the skateboard, preferably beneath the wheel truck 14, and includes an extensible cable 22 which can be uncoiled or released so that it can be attached around a secure object, such as a fixed lamp-post, bicycle rack, or the like. The combination lock assembly 20 includes a combination lock 24 having the cable 22 affixed within the lock 24 at one end (not seen) and being releasable at a second end 26 by depressing a lock release button 28. A recoil button 30 is provided which, when depressed, recoils the cable 22 back into the lock 24. The lock 24 further includes rotatable number wheels 32 via which the lock combination can be set. This form of combination lock 24 having a cable 22, lock release button 28, cable release button 30 and wheels 32, is essentially a conventional product. The combination lock 24 is affixed in any suitable manner, as by bolting or riveting to a sheet metal tab 36 or extrusion. The sheet metal tab or extrusion 36 is adapted to be affixed to the bottom of the skateboard underneath the wheel truck 14 via the bolts and nuts 18. The tab 36 has suitable holes which mate with the holes in the wheel truck 14 to allow this mounting arrangement. The bolts and nuts 18 can be further secured by using a liquid locking agent such as Loctite, or secured in any other suitable manner, so as to minimize the chance of disassembly of the lock assembly 20 from the truck 14 and board 10. A suitable decorative cover 38 having an end cap 39 can be provided as part of the lock assembly 20.

In use, the skateboarder merely sets the appropriate combination on the wheels 32 of the lock and depresses the lock release button 28 which allows the cable 22 to be detached at end 26. A length of the cable can then be pulled out of the lock 24 and wrapped around a secure object such as a lamp post or other device, and the end 26 reinserted into the lock 24 and the wheels 32 changed to thereby secure cable 22 in the lock 24, and thus secure the skateboard to the fixed object. The present arrangement is relatively compact and lightweight and does not interfere with or impede the operation of the skateboard 10, while still providing protection against theft. The combination lock can be replaced by a key lock if desired. However, the combination lock is preferred since the user does not have to keep, and keep track of, a key.

As is known to those skilled in the art, skateboards like skateboard 10 are quite flexible, and, thus, it is important that an item like the lock assembly 20 be formed of a material which also is somewhat flexible so as not to impede the flexibility of the board. Any suitable material can be used including aluminum, super tough nylon, and the like. It is also important that the assembly 20 be formed of a material which can withstand the impact when skidded on a hard or rough surface, such as a curb. The end cap 39 at the forward end of the assembly is suitably configured to minimize the chance of the lock assembly 20 catching on any item during use of the skateboard. Further, it is important that any structure added at or near the wheel truck 14 and wheels 15 and 16 not interfere with the flexing of the same and do not present any drag points to the wheels themselves.

Figure 2A:
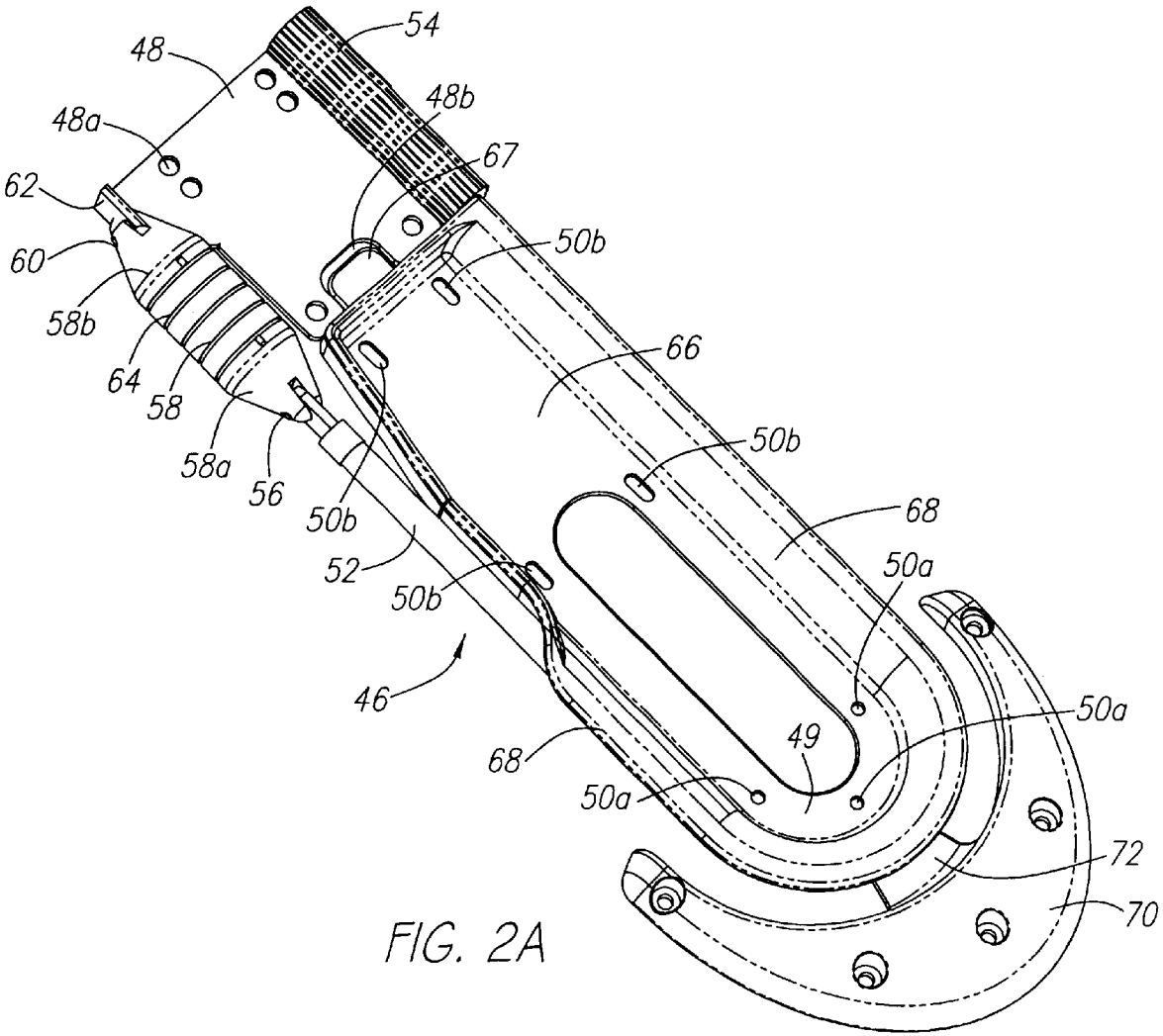
FIGS. 2A and 2B illustrate another form of the locking device in further detail.
Figure 2B:
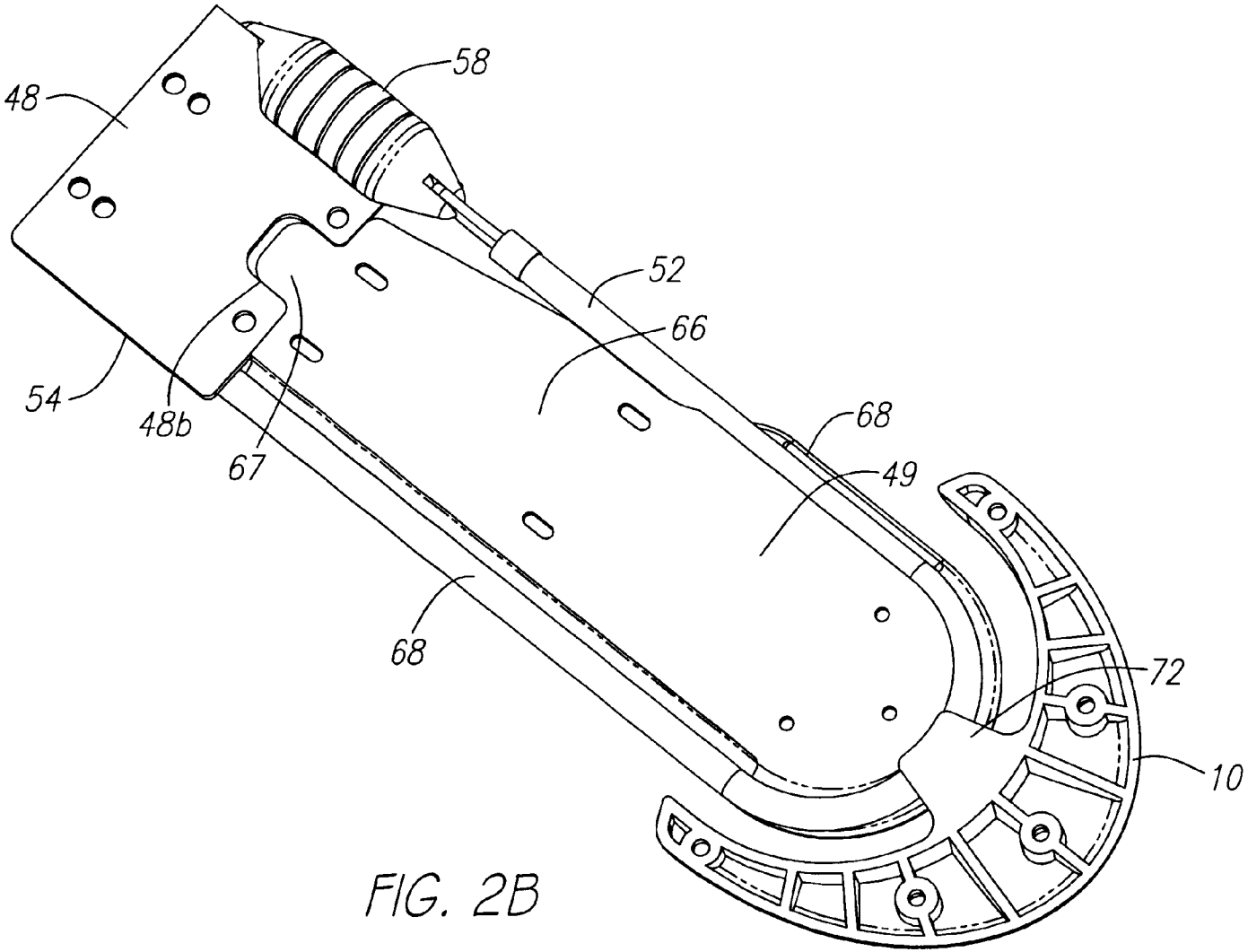

A second embodiment is illustrated in FIGS. 2A and 2B, and is similar to the embodiment of FIG. 1 in that a lock assembly is adapted to be mounted under the wheel of truck 14 (not shown in FIGS. 2A and 2B), but has a different form of combination lock arrangement. In this embodiment, the combination lock assembly 46 includes an extrusion 48 forming a base plate which is disposed underneath the wheel truck 14 (not shown in FIGS. 2A and 2B) to the skateboard 10 (not shown in FIG. 2). The base plate 48 includes as an integral part a tubular side section 54 to which an end of a cable 52 is secured. The base plate 48 has suitable mounting holes 48*a* to allow the same to be secured to the skateboard via the mounting bolts for the truck 14. The lock assembly 46 further includes the steel cable 52, preferably plastic coated and permanently affixed, as by swaging for example, to the tubular side section 54. The base plate 48 extrusion also includes an upstanding bracket 62. Thus, the first end of the cable 52 is secured in the section 54, and the second end is hingeably connected by a steel pin 56 to a removable end 58*a* of a conventional combination lock 58. A second end 58*b* of the combination lock 58 is secured via another steel pin 60 to the bracket 62. The combination lock 58 has a plurality of wheels 64 which can be rotated to set the combination and to allow the same to be opened at the end 58*a* to thereby enable the cable 52 to be released and then wrapped around a fixed object in a manner like the cable 22 of FIG. 1.

The combination lock assembly 46 further includes a cable retainer member or plate 66 attached to the board forward of the extrusion 48, and has a flanged forward section 68 for normally retaining the cable 52 underneath the flange 68 as seen in FIG. 2*a*. This arrangement helps prevent the cable from catching on objects while the skateboard is in use, but allows the cable to be pulled out from under the flange 68 when the combination lock 58 is released by setting the selected combination. The embodiment of FIG. 2A further preferably includes a molded plastic skid plate 70, suitably spaced from the flange 68 by a spacer tab 72 to provide room for the insertion and removal of the cable 52 under the flange 68. This skid plate 70 is disposed toward the forward end of the overall combination lock assembly and helps in preventing the assembly 46 from catching on objects when the skateboard is in use.

As was the case for the embodiment of FIG. 1, it is important that the lock assembly of FIGS. 2A and 2B be sufficiently flexible and designed so as not to impede flexibility of the associated skateboard. Preferably the retainer member 66 and skid plate 70 are formed of suitably strong but yet flexible material, such as super tough nylon, so as to be somewhat flexible and also withstand impact and abrasion. In the embodiment of FIGS. 2A and 2B, the member 66 is secured at its forward end 49 with suitable screws (not shown) mounted through screw holes 50*a*. Because of the flexing characteristics of the board, rearward screw holes 50*b* preferably are elongated, and the rear end of the member 66 is in the form of a tab and is not fastened to the board by screws but, instead, the rearwardly extending tab 67 fits within a slot 48*b* in the extrusion 48 to be disposed underneath the wheel truck base 14. This arrangement allows the retainer member 66 to be retained against the bottom of the skateboard (not shown in FIG. 2B), but allows some movement of the retainer member 66 forward and backwards with respect to the extrusion 48 to minimize impeding flexibility of the board.

Figure 3:
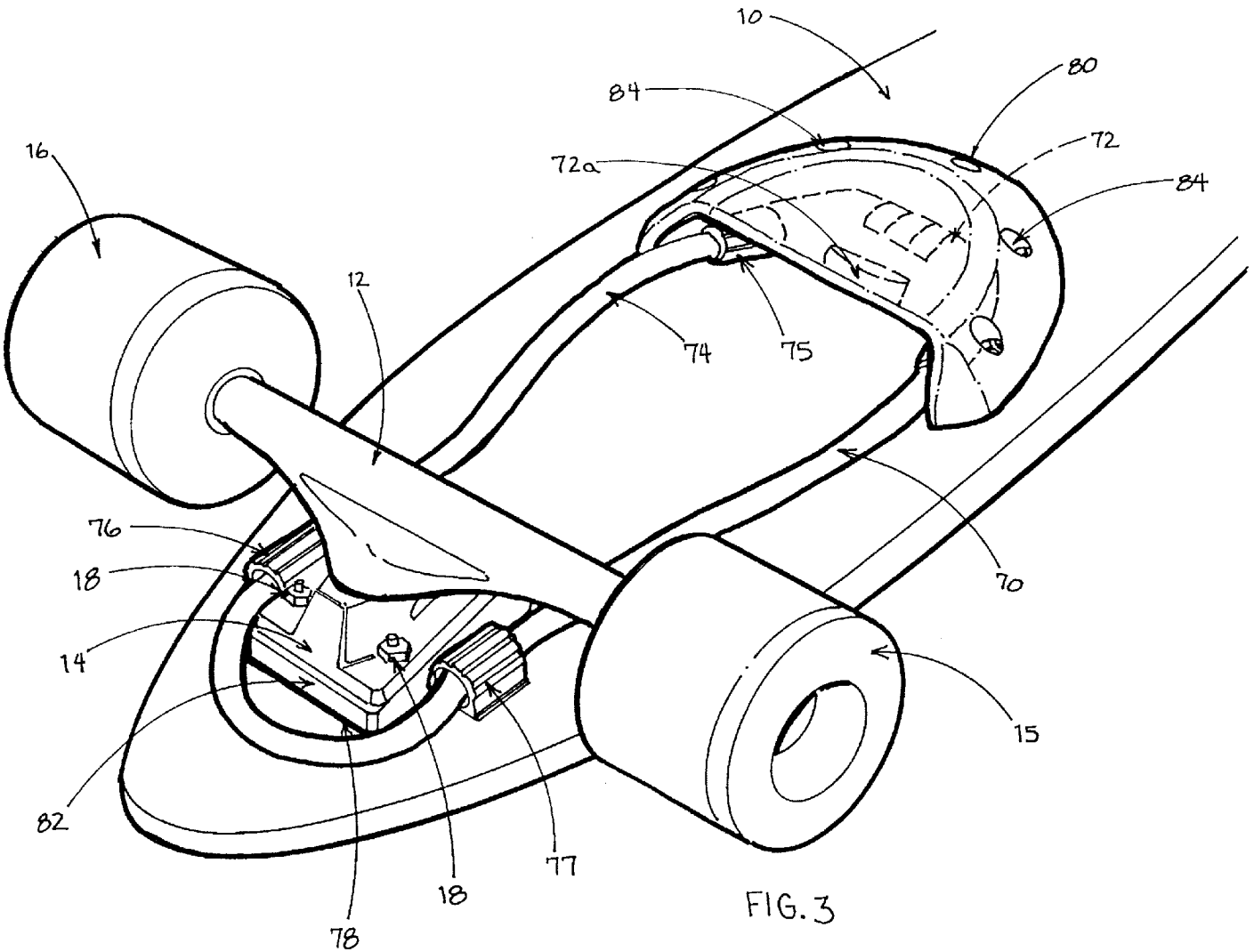
FIG. 3 is a perspective view of still another embodiment of a skateboard locking device.

A further embodiment is shown in FIG. 3, and like reference numerals are used for items which are the same as in FIG. 1, namely a skateboard 10, truck 12, truck base 14, wheels 15, 16 and mounting nuts and bolts 18. This embodiment differs in that the lock assembly 70 is entirely removable from the board 10. The assembly 70 comprises a combination lock 72 and cable 74 having an end 75 which releases from the lock 72 so that the cable 74 can be threaded through open barrels 76, 77 of an extrusion 78, preferably a machined aluminum extrusion and which is shown in greater detail in FIGS. 4A and 4C. The cable 74 can be released when the combination is set and a cable release 72*a* is depressed. A molded plastic skid plate 80 serves both as a skid plate and a cover or retainer for the combination lock 72. As will be apparent, the extrusion 78 is mounted underneath the truck base 14. The skid plate 80 includes a plurality of holes 84 to allow the same to be retained on the board by suitable wood screws.

Figure 4B:
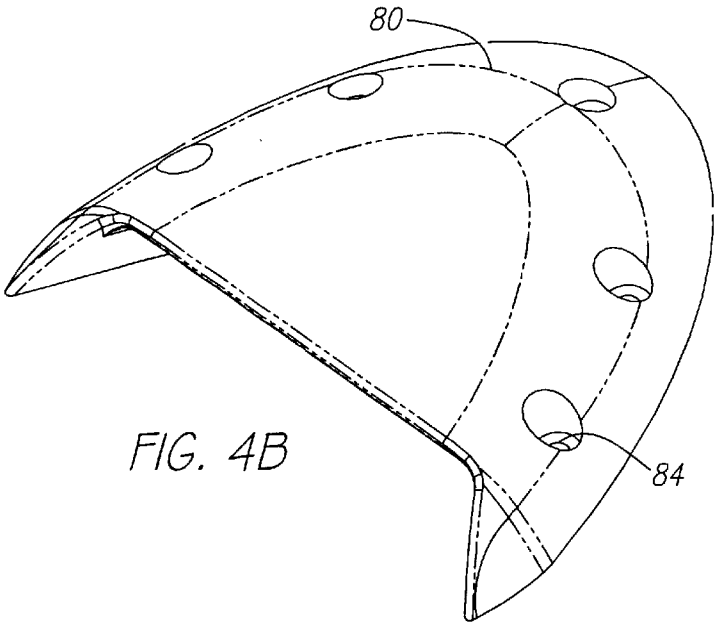
FIGS. 4A through 4D illustrate further details of the device of FIG. 3.
Figure 4A:
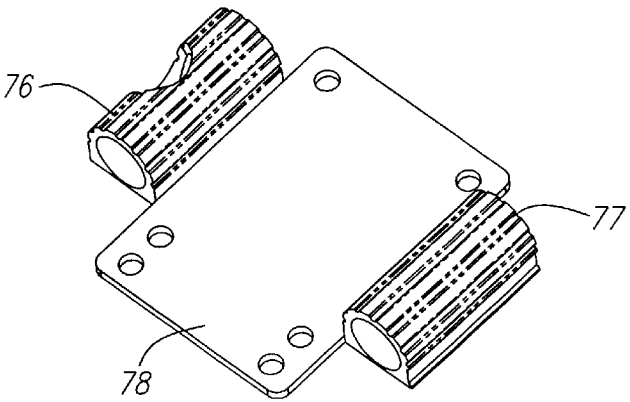
Figure 4D:
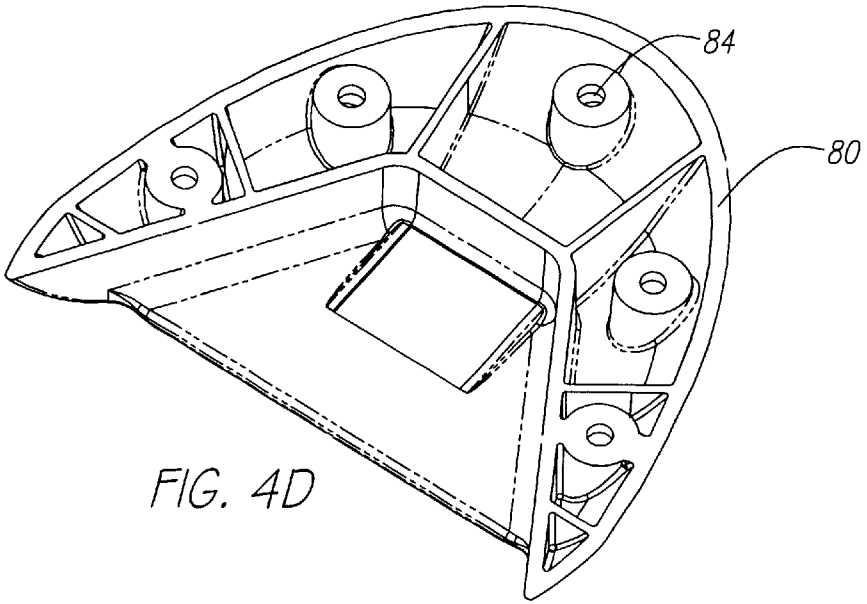
Figure 4C:
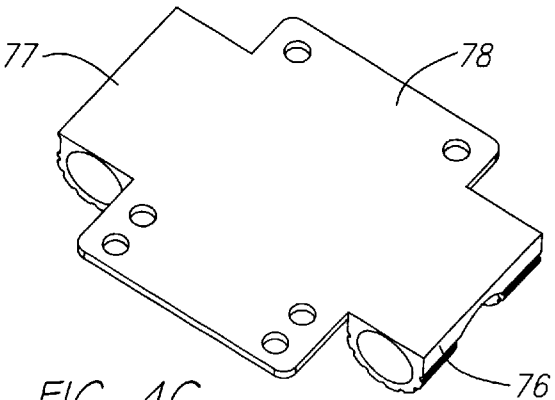
Figure 5A:
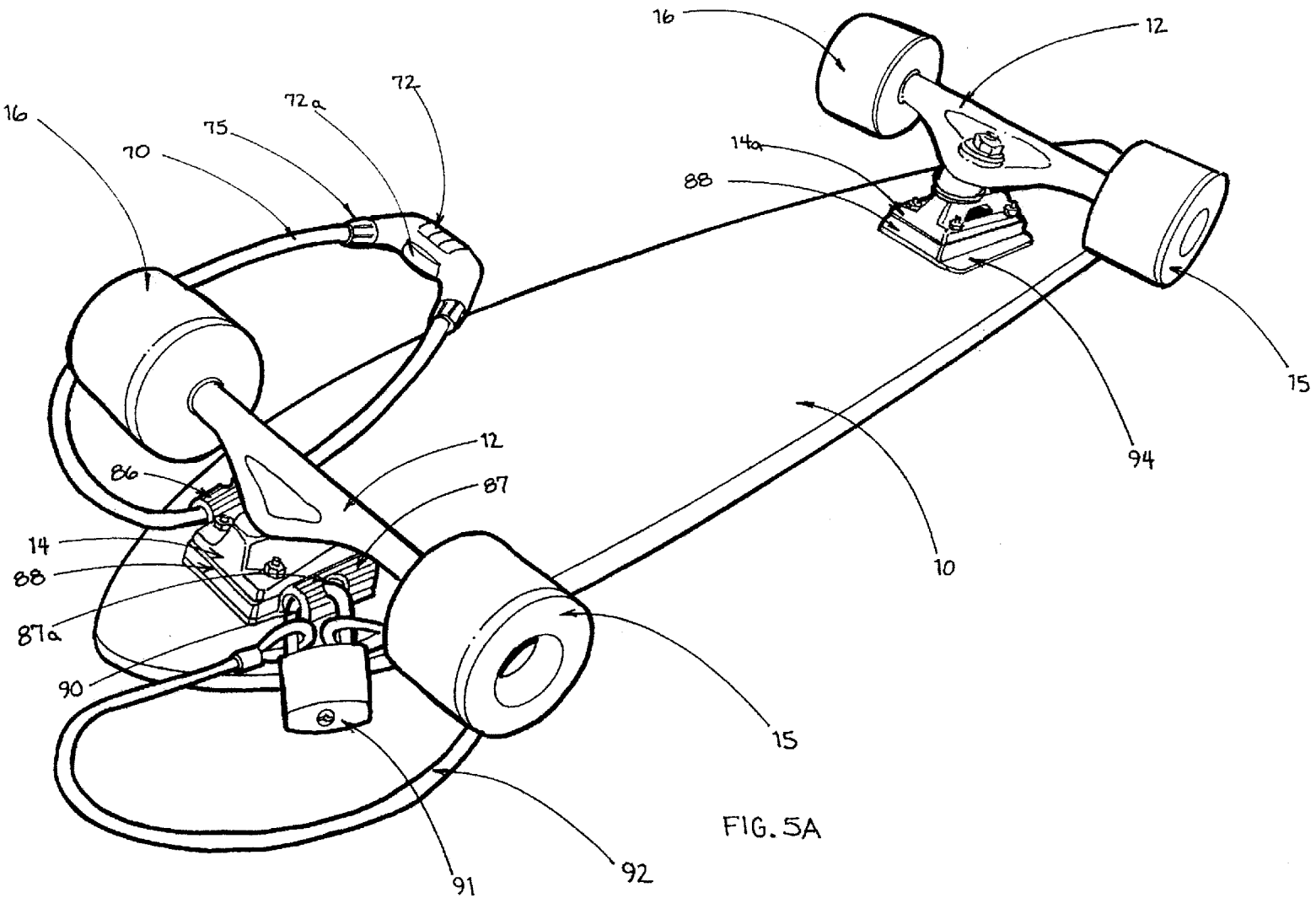
FIG. 5A is a perspective view of a skateboard with a modified form of locking device, and further illustrates the use of a spacer plate on one wheel truck, and FIG.

This arrangement allows the lock assembly 70 to either be mounted as shown in FIG. 3 or, alternatively, the lock assembly 70 can be removed from the board and carried around the neck of the skateboarder if desired. FIG. 5A shows an example of how the assembly 70 can be secured to the board extrusion. The relatively wide barrel sections 76 and 77 are relatively difficult to cut in the case of an attempted theft. Preferably, one of the barrel sections, such as section 77 as best seen in FIG. 4A is of a shorter length so as to allow the shackle of a typical padlock to fit within the opening therein if desired. A further alternative for allowing the use of conventional padlocks is shown in FIG. 5B and will be discussed subsequently.

Figure 5B:
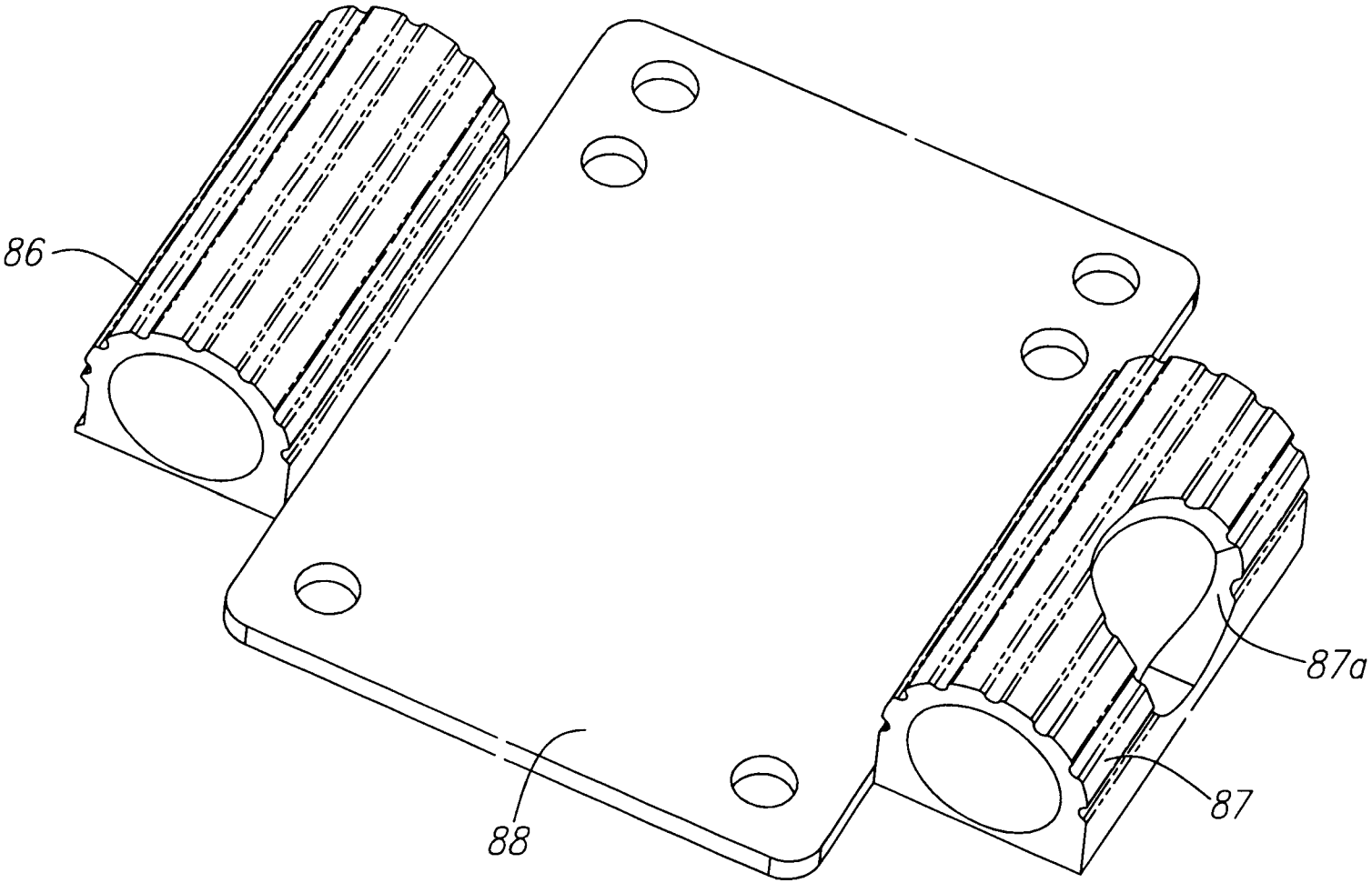

Turning now to FIGS. 5A and 5B, the same illustrate a modification of the embodiment of FIGS. 3 and 4 wherein an extrusion 88 similar to the extrusion 78 of FIG. 3 has side barrel sections 86 and 87 with at least one drilled hole 87*a* (note FIG. 5B) to more readily allow a short shackle 90 of a lock 91 to be locked to the extrusion 88 so as to enable a cable 92 to be locked about any suitable fixed object for security purposes. This FIG. 5A also illustrates how the lock assembly 70 can be fed through one of the barrels 86 for locking the board to a fixed object for security purposes.

When an item such as the extrusions 78 (FIG. 3), 88 (FIG. 5A) or plate or extrusion 36 and 48 (FIGS. 1 and 2) are added underneath one of the truck bases 14 of the skateboard, it is desirable to shim the second truck base 14*a* at the other end of the board with a spacer plate 94 as illustrated in FIG. 5A so as to provide an equal spacing of the truck 14*a* on the board like the spacing of the truck 14 caused by the addition of the extrusion or plate.

Turning now to FIG. 6, another embodiment is shown which is substantially identical to that of FIG. 1, but in this case for a snowboard 96. The combination lock assembly 20 is identical to that shown in FIG. 1, and includes the tab 36 which can be attached to the top of the board 96 via the snowboard boot bracket 97. The boot bracket 97 is conventional, except to the extent it or the tab 36 may need to be modified to fit the tab 36 underneath the boot bracket.

A still further embodiment is illustrated in FIG. 7, and in this case a lock assembly 100*a*–100*b* is provided for a pair of snow skis 102*a*–102*b* having typical bindings 104*a*–104*b* with respective bases 106*a*–106*b* for attachment to the skis.

The lock assemblies 100*a* and 100*b* in this embodiment may comprise a pair of assemblies 100*a* and 100*b* forming a two-part design so as to provide equal weight on both skis 102*a*–102*b*, although a single combination lock assembly could be used (similar to that shown in FIGS. 1 and 6) if desired. Each assembly 100*a* and 100*b* includes an elongated sheet metal plate 110*a*–110*b* which is secured under the binding plates 106*a*–106*b* to the respective skis 102*a*–102*b*. One of the two assemblies 100*a*–100*b* includes a combination or key lock, and in the embodiment illustrated in FIG. 7 the assembly 100*a* is shown with a combination lock 114 with an opening 115 for an end 116 of a cable 117 which, in turn, is fixed at 118 to the second lock assembly 100*b*. The lock assembly can include a recoil assembly in assembly 100*b* so as to allow the cable 117 to be fully retracted within assembly 100*b* when not in use. A recoil button 120 is provided for this purpose.

As an alternative to the combination lock 114, the lock assembly 100*a* can be a key lock. In this case, the forward end 124 of assembly 100*a* can be formed of flexible material, such as plastic or rubber, with a slit 125 to allow the end 126 to be pulled forwardly so as to uncover a key slot hole. This flexible end 126 arrangement allows the key slot hole to be covered while the skis are in use so as to prevent or minimize snow or other material entering the key slot hole.

A further lock arrangement is illustrated in FIG. 8 and comprises a cable coil assembly 130 housing a coil of cable 132. The assembly 130 includes a plurality of apertures 134 to allow the same to be mounted beneath the truck base 14 (not shown in FIG. 8). Preferably, the cable 132 retracts under spring pressure within the assembly 130.

FIG. 9 illustrates still another, and simpler arrangement for locking sports equipment, particularly skateboards. This device does not include its own built in lock (not shown but of the type used to lock bicycles) or cable assembly as in the other embodiments, but comprises a metal bracket 142 configured to fit, for example, under the truck base 14 (FIG. 1) and to provide inclined ribs 144, 146 with respective holes 144*a*, 146*a* for receiving a separate cable and lock which the skateboarder can carry in a pocket or the like. This assembly provides a very simple and inexpensive device which can be mounted between the truck base 14 and bottom of the skateboard 10 (FIG. 1) via mounting holes 148. An upstanding tab 150 can be integrally formed, and can have a recessed area 152 for a label containing a logo, instructions for use, or the like. The bracket 142 typically can be formed of 0.093 inch thickness 50/52 aluminum, with an anodized finish, which has been found to be of suitable structural integrity for use as a locking bracket.

While embodiments of the present invention have been shown and described, various modifications may be made without departing from the scope of the present invention, and all such modifications and equivalents are intended to be covered.

What is claimed is:

1. A snowboard, comprising:

an elongate board member;

a lock assembly comprising a tab attached to the board member, a lock housing attached to one end of the tab, and a lock in the lock housing;

a boot bracket attached to the board member over the tab of the lock assembly; and a cable having a first end affixed to the lock assembly and a second end that is receivable in the lock housing, the second end being releasably securable in the lock housing by the lock.

2. The snowboard of claim 1, wherein the cable is retractable within the lock housing.

3. The snowboard of claim 2, wherein the lock comprises a recoil button for retracting the cable into the lock housing when depressed.

4. The snowboard of claim 1, wherein the lock comprises one of a combination lock and a key lock.

5. The snowboard of claim 1, wherein the lock comprises a lock release button for releasing the second end of the cable from the lock housing.

6. The snowboard of claim 1, wherein the lock housing is configured for receiving at least a portion of the cable therein.

7. A locking apparatus for a snowboard having a boot bracket attached thereto, comprising:

a lock assembly including an elongate tab having first and second portions, the first portion being mountable between the boot bracket and the snowboard and having a plurality of holes for mounting the lock assembly to the snowboard, and a lock housing on the second portion of the tab;

a cable having a first end affixed to the lock housing and a second end that is receivable in the lock housing; and a lock in the lock housing for releasably locking the second end of the cable in the lock housing.

8. The locking apparatus of claim 7, wherein the cable is retractable within the lock housing.

9. The locking apparatus of claim 8, wherein the lock comprises a recoil button for retracting the cable into the lock housing when depressed.

10. The locking apparatus of claim 7, wherein the lock comprises one of a combination lock and a key lock.

11. The locking apparatus of claim 7, wherein the lock comprises a lock release button for releasing the second end of the cable from the lock housing.

12. The locking apparatus of claim 7, wherein the lock housing is configured for receiving at least a portion of the cable therein.

* * * * *

UNITED STATES PATENT AND TRADEMARK OFFICE

CERTIFICATE OF CORRECTION

PATENT NO. : 6,374,645 B1
DATED : April 23, 2002
INVENTOR(S) : Fontes

It is certified that error appears in the above-identified patent and that said Letters Patent is hereby corrected as shown below:

Title page,

U.S. PATENT DOCUMENTS,

| | | | | |
|---|---|---|---|---|
| 5531082 | 7/2/96 | Wolk et al. | 70 | 63 |

Signed and Sealed this

Third Day of September, 2002

*Attest:*

*Attesting Officer*

JAMES E. ROGAN
*Director of the United States Patent and Trademark Office*